US005842800A

United States Patent [19]

Bailey et al.

[11] Patent Number: 5,842,800

[45] Date of Patent: Dec. 1, 1998

[54] MULTI FUNCTION SENSING DEVICE FOR PRINTING APPARATUS

[75] Inventors: William F. Bailey, Guilford; David W. Hubbard, Stamford; Sungwon R. Moh; James R. Ralph, both of Wilton; Edward J. Twarog, Norwalk, all of Conn.

[73] Assignee: Pitney Bowes Inc., Stamford, Conn.

[21] Appl. No.: 775,787

[22] Filed: Dec. 31, 1996

[51] Int. Cl.[6] ..... B41J 29/42

[52] U.S. Cl. ..... 400/703; 400/582

[58] Field of Search ..... 400/703, 582, 400/202, 202.1, 202.2, 705.1, 711; 101/484, DIG. 30, DIG. 46

[56] References Cited

U.S. PATENT DOCUMENTS

| | | | |
|---|---|---|---|
| 4,184,781 | 1/1980 | Ota | 400/124 |
| 5,531,530 | 7/1996 | Kuramoto et al. | 400/621 |
| 5,644,348 | 7/1997 | Shimoyama et al. | 400/582 |

FOREIGN PATENT DOCUMENTS

| | | | |
|---|---|---|---|
| 63-280671 | 11/1988 | Japan | 400/703 |
| 1-90761 | 4/1989 | Japan | 400/703 |
| 3-155965 | 7/1991 | Japan | 400/582 |

*Primary Examiner*—Edgar S. Burr
*Assistant Examiner*—Anthony H. Nguyen
*Attorney, Agent, or Firm*—Steven J. Shapiro; Melvin J. Scolnick

[57] ABSTRACT

A printing apparatus is disclosed which has various operating components, and which includes a single sensing means for sensing certain operational characteristics of the operating components to monitor the operational status thereof for the purpose of either providing an operator perceptible indication that a certain operational characteristic of one of the operating components is not in a condition for normal operation of the printing apparatus. The single sensing means includes a photo detecting means mounted on the inside surface of the cover of a housing for the operating characteristics of the printing apparatus, and an actuating means mounted on an ink cartridge which is mounted on and movable with a moving print head, such that the sensing means can provided an ink dication of whether the cover is open or closed, whether the ink cartridge is present or absent, whether the print head is in a proper position for commencing a normal cycle of operation, and in one variation of an alternate embodiment of the invention, whether there is sufficient ink in the ink cartridge for normal operation of the printing apparatus, and in another variation thereof, how much ink is in the ink cartridge at all times between full and insufficient for normal operation of the printing apparatus.

13 Claims, 8 Drawing Sheets

18
65
22
10
64
66
60
34
26
80
54
85
24
82
84
100
16
86
32
40

MULTI FUNCTION SENSING DEVICE FOR PRINTING APPARATUS

BACKGROUND OF THE INVENTION

The present invention relates generally to the field of printing apparatus, and more particularly to a printing apparatus having a sensing device for monitoring changes in the status of certain operational characteristics of various operating components of the printing apparatus.

Although the present invention may be adapted for use with other forms of printing apparatus, it is particularly intended to use with various types of printing devices which utilize ink jet technology in one form or another.

In its broadest aspects, a printing apparatus utilizing ink jet technology typically includes a print head having a plurality of minute apertures formed in one or a pair of linear arrays on an aperture plate, and means within the print head for causing minute droplets of ink to be ejected from the apertures in a predetermined sequence as controlled by a microprocessor in order to have the individual droplets of ink form a desired image on an image receiving medium as the print head is moved back and forth across a printing path. Typically, the printing apparatus is enclosed within a housing which includes suitable structure defining a path along which the image receiving medium is moved to receive successive lines of the image as the print head is moved back and forth within the housing along the printing path.

The full extent of movement of the print head includes a storage or capping position located at one end of the full path of movement at which the ink ejecting apertures are maintained in a moist environment to prevent ink from drying in the apertures between printing operations which would prevent improper operation of the printing device. There is also a standby position of the print head adjacent the storage position to which the print head returns after each movement across the printing path, and at which the print head remains during brief interruptions of the printing operation, such as for skipping lines on a sheet of imaging receiving medium or changing to a different sheet.

In the particular environment of the present invention, the printing apparatus is a component of a mailing machine, and is used to print postage indicia on successive envelopes passed through the mailing machine. Because of the unique nature of printing postage indicia, which in effect is money, it is highly desirable generally, and in some instances necessary, to print the entire indicia in a single pass of the print head component of the printing apparatus, and with virtually absolute certainty that a proper printing operation will occur with each cycle of operation of the printing apparatus.

Thus, there are several operational characteristics of the major components of the printing apparatus which should be monitored during operation thereof in order to ensure that it continues to operate in a normal manner. One of these characteristics is the position of the cover of the aforementioned housing which encloses the major operating components of the printing apparatus, which should not be operated unless the cover is closed to avoid possible jamming of an envelope in the printing apparatus or operator injury. Unless the sensing device which senses the position of the cover disables operation of the printing apparatus if the cover is not closed, which often is the case, it should at least provide an operator perceptible signal that the cover is open, and that the printing apparatus should not be operated, either intentionally or inadvertently.

Another characteristic is the presence or absence of an ink cartridge on the print head, since operation of the printing apparatus without an ink cartridge in place will result in documents passing through the printing apparatus with no printing taking place. This can be a source of considerable annoyance, including loss of funds, especially in the case of a mailing machine which, as previously indicated, is the preferred environment in which the present invention resides.

Still another characteristic which should be monitored is whether or not, even if the ink cartridge is in place on the print head, there is sufficient ink in the cartridge for proper operation of the printing apparatus. Thus, it is highly advisable to monitor the supply of ink in the ink cartridge so that a suitable warning is given when the supply of ink has been depleted to the point where printing cannot continue, or can continue for only a limited number of additional printing cycles.

Finally, a still further characteristic is the position of the print head with respect to the total extent of travel thereof, i.e., whether or not the print head is actually in either the storage or standby positions from which a normal printing cycle of operation can commence. In the absence of monitoring this characteristic, it is possible that a printing cycle of operation may commence with the print head already located in the printing path portion of its total extent of movement, which can result in an improper printing operation in which only a portion of an indicia will be printed during the cycle of operation.

Prior to the present invention, any one or some of these characteristics were monitored by means of individual condition sensing devices, e.g., a mechanical contact switch for determining whether a cover is closed, a similar switch for determining whether an ink cartridge is in place on the print head, one of a variety of liquid level detecting devices for determining an adequate supply of ink, and still another suitable device for determining the location of the print head. While these devices were functionally adequate to monitor the status of the operational characteristics of the various operating components of the printing apparatus, the fact that so many different detecting devices were required considerably increased the cost of manufacturing the printing apparatus, and also provided considerably more possibility for instances of mechanical or electronic failure, than would be the case if all of these operational characteristics could be monitored by a single detecting device.

Thus, there is a need for a printing apparatus, particularly of the ink jet type, in which the status of a plurality of operational characteristics of various operating components can be monitored by a single sensing device, thereby avoiding the unnecessary added expense and opportunity for equipment failure inherent in prior art printing apparatus monitoring systems.

BRIEF SUMMARY OF THE INVENTION

The present invention substantially obviates, if not entirely eliminates the shortcomings and disadvantages of prior art solutions to the foregoing problems in a manner which effectively achieves the above and hereinafter stated objects of the invention. The invention is directed toward providing certain types of printing apparatus with a unique system for sensing changes in the status of certain operational characteristics of various operating components of the printing apparatus for the purpose either of providing an operator perceptible indication of a change in the status of an operational characteristic, or directly controlling further operation of the printing apparatus, or both.

In its broader aspects, the principles of the present invention are embodied in a printing apparatus having various operating components, and means for sensing certain operational characteristics of the operating components to monitor the operational status thereof. Within this environment, the printing apparatus comprises a housing for containing various operating components of the printing apparatus, the housing including a cover and means mounting the cover for movement between a closed position and an open position in which the operating components are accessible. A print head is disposed within the housing, and there is means in the housing mounting the print head for reciprocating movement from a storage position to a standby position, from the standby position across a printing path, back across the printing path to the standby position, and optionally back to the storage position. An ink cartridge is mounted on the print head for movement therewith. There is a single sensing means operatively associated with the cover and the ink cartridge for monitoring changes in the status of certain operational characteristics of the cover, the print head and the ink cartridge. Finally, there is means responsive to operation of the sensing means for generating an operator perceptible indication of a change in the status of the operational characteristics of the cover, the print head, and the ink cartridge, and/or altering the operation of the printing apparatus, in accordance with changes in the status of the operational characteristics of the cover, the print head and the ink cartridge, The result is that an operator of the printing apparatus can be apprised of, and/or the operation of the printing apparatus can be directly controlled in response to, changes in the operational characteristics of the cover, the print head and the ink cartridge of the printing apparatus during operation thereof.

In some of its more limited aspects, the single sensing means comprises a condition detecting means in the form of a photo detector which is mounted on the inside surface of the housing cover, and an actuating means mounted on the ink cartridge for actuating the photo detector in accordance with the changes in the status of the operational characteristics.

The photo detector comprises a substantially U-shaped housing having a pair of spaced apart legs, a light emitter disposed in one of the legs and a light receptor disposed in the other, and the actuating means comprises an elongate element mounted on the ink cartridge in a position such that it is disposed between the depending legs when the cover is in the closed position, so that the elongate element obstructs the passage of light from the light emitter from reaching the light receptor when the cover is in the closed position, when the ink cartridge is mounted on the print head, and when the print head is disposed at the storage position or the standby position.

The means for providing the operator perceptible indication and/or for altering the operation of the printing apparatus comprises a counter means responsive to movement of the print head from the storage position toward the standby position for generating successive signals each representative of a discrete increment of movement of the print head. There is a microprocessor for controlling various operations of the printing apparatus which is connected to the counter means and is responsive to a predetermined number of the signals for ascertaining whether any of the operational characteristics of the cover, the print head and the ink cartridge are inappropriate for continued operation of the printing apparatus. Further, an indicating/disabling means is responsive to operation of the microprocessor in determining whether any of the operational characteristics are inappropriate for continued operation of said printing apparatus for generating the operator perceptible indication and/or altering the operation of said printing apparatus.

In one embodiment of the invention, the sensing means is constructed and arranged to monitor only whether the cover is in the open or closed position, whether the ink cartridge is in place and whether the print head is in an appropriate position to commence a printing cycle of operation.

In another embodiment, the sensing means and the ink cartridge are constructed and arranged to add to the preceding functions an indication of when the supply of ink in the ink cartridge is depleted to the point where it is insufficient to maintain normal operation of the printing apparatus beyond a predetermined number of further printing cycles of operation.

In a variation of that embodiment, the sensing means and the ink cartridge are further constructed and arranged to add to the preceding functions an ongoing indication of how much ink remains in the ink cartridge at any given time between installation of an ink cartridge with a full supply of ink when becomes insufficient as aforesaid.

The microprocessor includes software by which it is programmed to recognize a predetermined number of signal counts from the counter means, which are representative of a predetermined increments of movement of the print head, to make a determination whether to activate the indicating/disabling device in accordance with whether the sensing means determines that an inappropriate condition for continued operation of the printing apparatus exists. The microprocessor is programmed to recognize the appropriate signal counts so it will not activate the indicating/disabling device if a change in condition of the sensing means is to be expected in the normal course of operation of the printing apparatus.

Having briefly described the general nature of the present invention, it is a principal object thereof to provide a printing apparatus in which a single sensing means is utilized to monitor changes in the status of certain operational characteristics of various operating components of the printing apparatus.

Another object of the present invention is to provide a printing apparatus in which a single sensing means is utilized to monitor whether a cover attached to a housing for the operating components of the printing apparatus is in an open or closed position, whether an ink cartridge is mounted on the movable print head, whether there is an ample supply of ink in the ink cartridge for proper operation of the printing apparatus, and whether the print head is in one of two possible positions from which a normal cycle of operation of the printing apparatus can commence.

Still another object of the present invention is to provide a printing apparatus in which the sensing means which monitors changes in the operational characteristics of the operating components of the printing apparatus either causes an operator perceptible indication that such change has occurred, or directly controls further operation of the printing apparatus in response to such change, usually by disabling further operation after a predetermined number of printing cycles, or both.

A still further object of the present invention is to provide a printing apparatus in which the sensing means is very inexpensive to manufacture, is highly reliable in operation and requires virtually no operator maintenance.

These and other objects and advantages of the present invention will become more apparent from an understanding of the following detailed description of presently preferred modes of carrying out the invention, when considered in conjunction with the accompanying drawings.

DETAILED DESCRIPTION OF THE INVENTION

Figure 1:
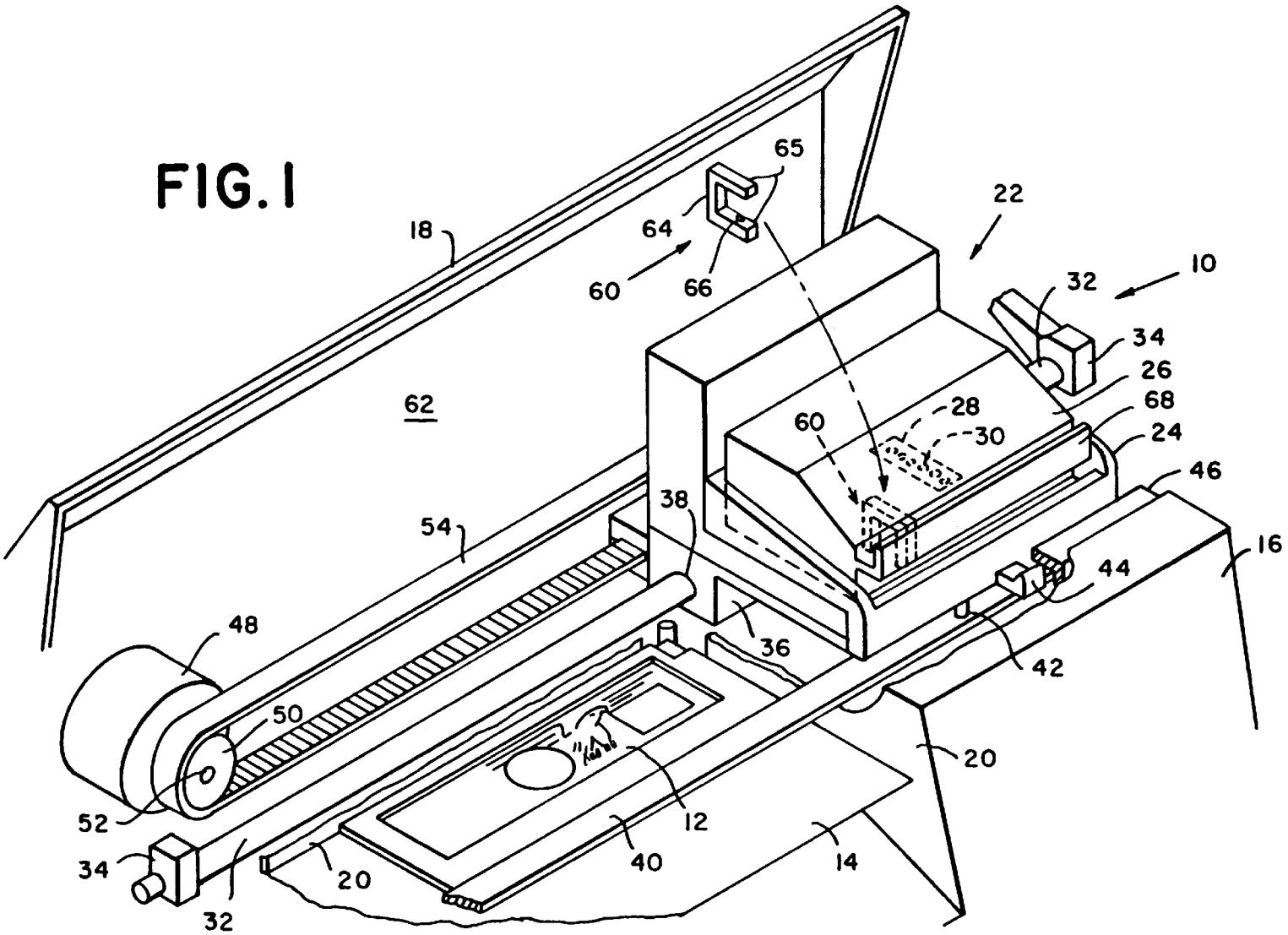
FIG. 1 is a fragmentary perspective view of a printing apparatus embodying the principles of the present invention, showing a housing containing the principal components of the printing apparatus and a cover for the housing shown in an open position.

Referring now to the drawings, and particularly to FIG. 1 thereof, the principles of the present invention are embodied in a printing apparatus indicated generally by the reference numeral 10. The printing apparatus 10 is illustrated as being utilized in conjunction with a mailing machine which prints a postage indicia 12 on the upper right corner of an envelope 14 utilizing a printing device based on the aforementioned ink jet technology. It should be understood, however, that the principles of the present invention are applicable to other forms of printing technology and also when used in conjunction with other printing applications.

The printing apparatus 10 includes a suitable housing 16 which contains and encloses substantially all of the operating components of the printing apparatus 10. The housing 16 includes a cover 18 which is secured to the housing 16 in any suitable manner, such as by being hinged to a rear portion of the housing 16 so that it can pivot from a closed position to the open position shown in FIG. 1 to expose and render accessible the operating components of the printing apparatus 10. The housing 16 includes a suitable registration wall 20 against which an image receiving medium, which in the case of the mailing machine shown in FIG. 1 is the envelope 14, is positioned so that the printed image, which in this case is the postage indicia 12, will appear in the desired location on the envelope 14.

The printing apparatus 10 includes a print head assembly, indicated generally by the reference numeral 22, which includes the necessary components to effect a printing operation. Thus, the print head assembly 22 includes a suitable housing 24 on which an ink cartridge 26 is removably mounted. The ink cartridge 26 includes an aperture plate 28 mounted on the bottom surface thereof and which includes at least one linear array of minute apertures 30 through which ink is ejected in minute droplets to form the postage indicia image 12 on the envelope 14, as the print head assembly 22 is moved in a manner yet to be described across a printing path. The ink is caused to be ejected through the apertures 30 in a predetermined sequence and for a predetermined duration to produce the desired image 12 by a microprocessor 31 (FIG. 20) which is part of any of a number of ink ejecting techniques well known in the ink jet technology and therefore which need not be further described herein, except as noted below, for an understanding of the present invention.

There is means in the housing 16 for mounting the print head assembly 22 for reciprocating movement from a storage position to a standby position, from the standby position across a printing path, back across the printing path to the standby position, and optionally, as further described below, back to the storage position. Thus, still referring to FIG. 1, a round rail 32 is suitably mounted in the housing 16 as by the brackets 34 and which extends substantially from one side of the housing 16 to the other. A mounting portion 36 of the print head assembly 22 includes a suitable aperture 38 through which the guide rail 32 extends so that the print head assembly 22 can move along the guide rail 32. A flat guide bar 40 is also suitably mounted in a forward portion of the housing 16, and the print head assembly 22 includes a bearing member 42 which rides on the upper surface of the guide bar 40. A forwardly extending protrusion 44 is mounted on the print head assembly 22, the forward end of which underlies the lower surface of an upper guide bar 46 which is affixed to the housing 16 to maintain the print head assembly 22 in the operative position shown in FIG. 1.

The printing apparatus 10 is also provided with a suitable drive mechanism for moving the print head assembly 22, which in the form of the invention shown in FIG. 1, includes a drive motor 48 having a pulley 50 suitably mounted on the end of a drive shaft 52, the pulley 50 driving a suitable timing belt 54 which passes around another pulley (not shown) located behind the print head assembly 22. The mounting portion 36 of the print head assembly 22 is suitably connected to the belt 54 so that movement of the belt 54 by the motor 48 moves the print head assembly 22 along the guide rail 32 and the guide bar 40. The motor 48 is a reversible motor and is driven in the desired direction and at the desired speed by the microprocessor 31.

As previously stated, the full extent of movement of the print head assembly 22 from one end of the guide rail 32 to the other includes an extreme right hand position, as viewed in FIG. 1, which is generally referred to as the storage or capping position. In this position, the aperture plate 28 and the apertures 30 are maintained in a moist environment to prevent ink from drying on the face of the aperture plate 28 and in the apertures 30 during periods when the printing apparatus is not operating, which would prevent proper operation of the printing apparatus. Again, this is accomplished in the ink jet technology by a number of well known techniques, such as by positioning the aperture plate 28 over a compliant elastomeric cap that isolates the aperture plate 28 from atmosphere. Further description of these techniques are not believed necessary for an understanding of the present invention.

Adjacent the storage or capping position, a short distance to the left of the position of the print head assembly 22 in FIG. 1, is a standby position, which in typical operation of any ink jet printer, is the position from which the print head assembly 22 commences movement across the image receiving medium to effect a printing operation. It is also the position to which the print head assembly 22 returns after each printing movement across the image receiving medium, either to wait while the image receiving medium is advanced to another printing line, if that occurs, or to wait while another image receiving medium is inserted in the printing apparatus in the event that the entire image is printed during one pass of the print head across the image receiving medium, which is the necessary mode of operation when printing postage indicia in a mailing machine. Thus, the motor 48 and the belt 54, under appropriate microprocessor control, operate to move the print head assembly 22 from the storage position as shown in FIG. 1 to the standby position to the left of the position shown in FIG. 1, and then across the printing path to the opposite end of its movement along the guide rail 32 and the flat guide bar 40 during a printing operation, and then back across the printing path to the standby position to await the next printing operation, or optionally to the storage position if further operation of the printing apparatus 10 is not carried out within a predetermined period of time.

The printing apparatus 10 of the present invention further includes a single sensing means operatively associated with the cover 18 and the ink cartridge 26 for monitoring changes in the status of certain operational characteristics of the cover 18, the print head assembly 22 and the ink cartridge 26. These characteristics include the position of the cover 18, the position of the print head assembly 22, the presence or absence of the ink cartridge 26 on the print head assembly 22, and, in another embodiment of the invention, the presence or absence of ink in the ink cartridge 26. There is also means responsive to operation of the sensing means for providing an operator perceptible indication of changes in the status of the operational characteristics of the cover 18, the print head assembly 22, the ink cartridge 26 and, in the other embodiment, the presence or absence of ink within the ink cartridge 26, and/or altering the operation of the printing apparatus 10 in accordance with changes in the status of the operational characteristics of the cover 18, the print head assembly 22 and the ink cartridge 26.

Referring now to FIGS. 1 through 5, which illustrate one embodiment of the invention, the single sensing means includes a suitable photo detector device, indicated generally by the reference numeral 60, which is suitably affixed to the inside surface 62 of the cover 18. The photo detector 60 includes a generally U-shaped housing 64 having a pair of spaced apart, parallel legs 65, and a light emitter 66 is disposed in one of the legs 65, and a light receptor (not shown) is disposed in the opposite leg in position to normally receive light from the emitter 66. The sensing means further includes an elongate light obstructing flag 68 mounted along the forward edge of the ink cartridge 26 in a position to be disposed between the legs 65 of the U-shaped housing 64 when the cover is moved from the open position shown in solid lines in FIG. 1 to the closed position, which is represented by the dotted line position of the photo detector 60.

Figure 2:
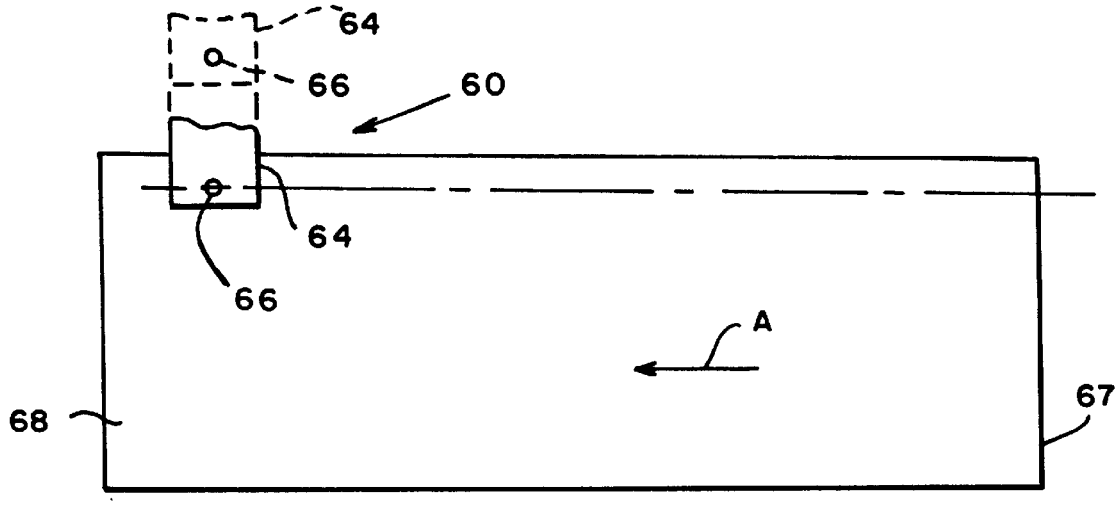
FIG. 2 is a fragmentary view of the photo detector device and the flag mounted on the ink cartridge showing certain operational characteristics of the photo detector device.
Figure 3:
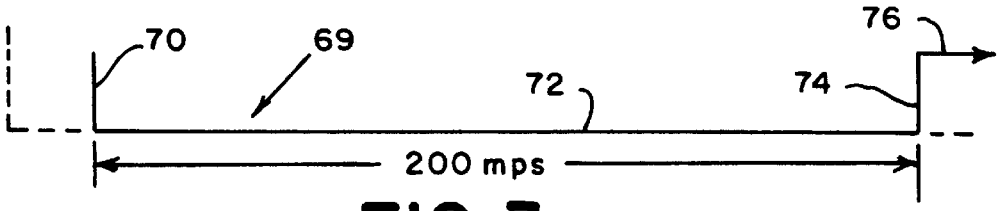
FIG. 3 is a line diagram illustrating the respective "on" and "off" operational characteristics of the photo detector device illustrated in FIG. 2.

As best seen in FIGS. 2 and 3, when the cover 18 is in the closed position, the ink cartridge 26 is properly mounted on the print head 22, and the print head 22 is in the extreme right hand storage position shown in FIG. 1, the housing 64 of the photo detector 60 will be in the solid line position shown in FIG. 2, in which the flag 68 is disposed between the legs 65 of the housing 64 so as to obstruct the passage of light from the light emitter 66 to the light receptor in the opposite leg 65. The dotted line position of the housing 64 represents the location of the photo detector 60 when the cover 18 is not fully closed.

Figure 20:
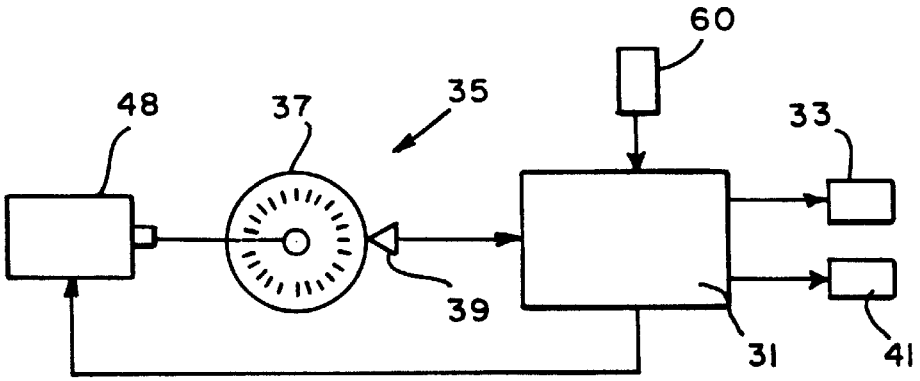
FIG. 20 is a simplified electrical schematic of the major control components of the printing apparatus.

FIGS. 2 and 3 represent the sequence of operational changes in the condition of the photo detector 60 during the initial stages of a cycle of operation of the print head assembly 22, i.e., when the cover 18 is moved from the open position to the closed position, and when the print head 22 is moved from the storage position to the printing path, which is substantially that part of the total movement of the print head 22 that overlies the indicia image 12. Thus, while the cover 18 is in the raised position shown in FIG. 1 and in the dotted line position shown in FIG. 2, light from the light emitter 66 is reaching the light receptor, and this provides a signal to the microprocessor 31 that one of three conditions is present that will prevent normal operation of the printing apparatus, i.e., that the cover 18 is not fully closed, that the ink cartridge 26 with the flag 68 is not installed on the print head 22, or that the print head 22 has been moved from either the storage position or the standby position to a location somewhere along the printing path from which a normal cycle of operation cannot commence. The microprocessor 31 then sends a signal to an indicating/disabling device 33 (FIG. 20) which either generates an operator perceptible indication that the printing apparatus 10 is not in proper condition for operation, or disables further operation of the printing apparatus 10, or both, as further explained below. In various manners well known in the art, that indication can be in the form of an audible signal such as an intermittent beep or continuous tone, or a visible signal such as a light or a digital display, or a combination of both, all of which are represented in FIG. 20 by the box labeled 33.

It is also possible, if the device 33 is any suitable form of operation disabling device, for the microprocessor 31 to entirely disable operation of the printing apparatus 10 when the photo detector 60 is sensing any of the above mentioned conditions under which the printing apparatus 10 will not operate properly. It is further possible for the microprocessor 31 to provide both an operator perceptible indication of an improper operating condition, and also to disable further operation of the printing apparatus 10, by providing a combined device 33 which has the capability of both providing the operator perceptible indication and also disabling operation of the printing apparatus 10.

In FIG. 3, the solid line, indicated generally by the reference numeral 69, represents the change in the operational conditions of the photo detector 60 during the initial stages of operation. When any of the above mentioned conditions for improper operation of the printing apparatus 10 exist, the photo detector 60 is in an "on" condition, in that the light receptor is receiving light from the light emitter 66. As soon as the light from the light emitter 66 is obstructed by the flag 68, such as the cover 18 being moved from the raised position to the closed position, the photo detector 60 changes to an "off" condition, and this sends a signal to the microprocessor 31 indicating that the printing apparatus 10 is now in condition for operation, in that the cover 18 is down, an ink cartridge 26 with the flag 68 is properly mounted on the print head 22, and the print head is in the storage position or the standby position from either of which a normal printing operation can commence. This change is represented by the vertical segment 70 of the line 69.

As the print head 22 begins to move from the storage position to the standby position, as indicated by the arrow A in FIG. 2, the photo detector 60 remains in the "off" condition, until the print head 22 has moved sufficiently far in the direction of the arrow A to bring the right hand end 67 of the flag 68 to the photo detector 60. When the end 67 of the flag 68 passes the light emitter 66, light is no longer obstructed from reaching the receptor mounted in the opposite leg 65 of the housing 64, and the photo detector 60 reverts back to an "on" condition. This change in condition is transmitted to the microprocessor 31, which would then normally cause the microprocessor 31 to activate the indicating/disabling device 33.

However, with reference to FIG. 20, the microprocessor 31 includes a suitable electronic counter, of which several varieties are well known in the art, such as the motor pulse counter, indicated generally by the reference numeral 35, which is used in the present invention. This counter includes a slotted wheel 37 suitably connected to the drive shaft 52 of the motor 48 so as to be driven thereby, and a photo detector 39 which senses light through the slots in the wheel 37 and sends a signal to the microprocessor 31, corresponding to a known amount of rotation of the motor drive shaft 52, each time a slot in the wheel 37 passes the photo detector 39. Thus, the microprocessor 31 can ascertain the precise location of the print head 22 at any time after the print head 22 leaves the storage position which would normally cause the microprocessor 31 to activate the indicating/disabling device 33. The horizontal segment 72 of the line 69 in FIG. 2 represents the movement of the print head 22 from the storage position to the standby position, which for example may be assumed to correspond to a count of 200 motor pulses. If the print head 22 continues to move after that count, it is then in the printing path portion of its total extent of movement, and the flag 68 no longer obstructs light from the light emitter 66 reaching the light receptor, so that the photo detector 60 reverts back to an "on" condition, as indicated by the vertical segment 74 of the line 69, and it will remain in this condition, as indicated by the horizontal segment 76, until the print head 22 completes the printing operation and returns to the standby position. However, the microprocessor 31 has been programmed to recognize the 200 motor pulse count as indicating that the print head is in the printing path and that a normal printing cycle of operation is taking place, so that it does not activate the indicating/disabling device 33, so that the printing cycle can continue without interruption and the print head 22 will return in normal manner either to the standby position or the storage position, as the case may be.

Figure 4:
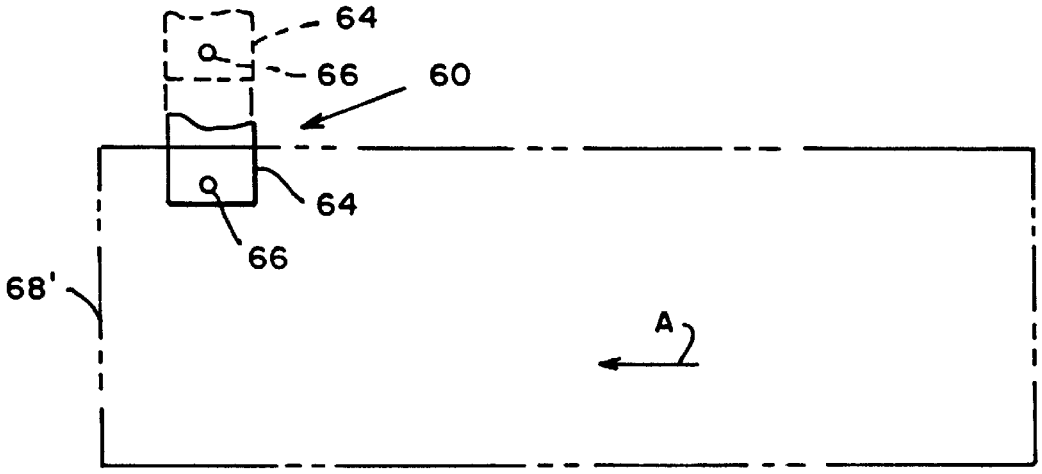
FIG. 4 is a view similar to FIG. 2 but illustrating the operational characteristics of the photo detector device with the ink cartridge and the flag mounted thereon not properly installed in the printing device.
Figure 5:
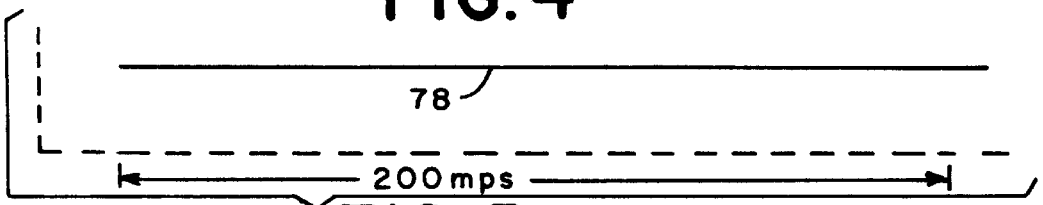
FIG. 5 is a line diagram similar to FIG. 3 illustrating the operational characteristics of the photo detector device illustrated in FIG. 4.

FIGS. 4 and 5, which are similar to FIGS. 2 and 3 respectively, illustrate the operational condition that exists in the event that the ink cartridge 26 and the flag 68 attached thereto is not installed. Thus, the dotted outline 68' indicates that the cartridge is not installed, which causes the photo detector 60 to remain in an "on" condition, as indicated by the solid line 78 in FIG. 5. The result is that, since the microprocessor has not counted the initial 200 motor pulses, it will activate the indicating/disabling device 33 to maintain an operator perceptible signal and/or prevent operation, even after the cover 18 has been closed, thereby providing a continuous indication that the printing apparatus 10 is not in condition for proper operation, or disabling operation of the printing apparatus, or both.

Figure 6:
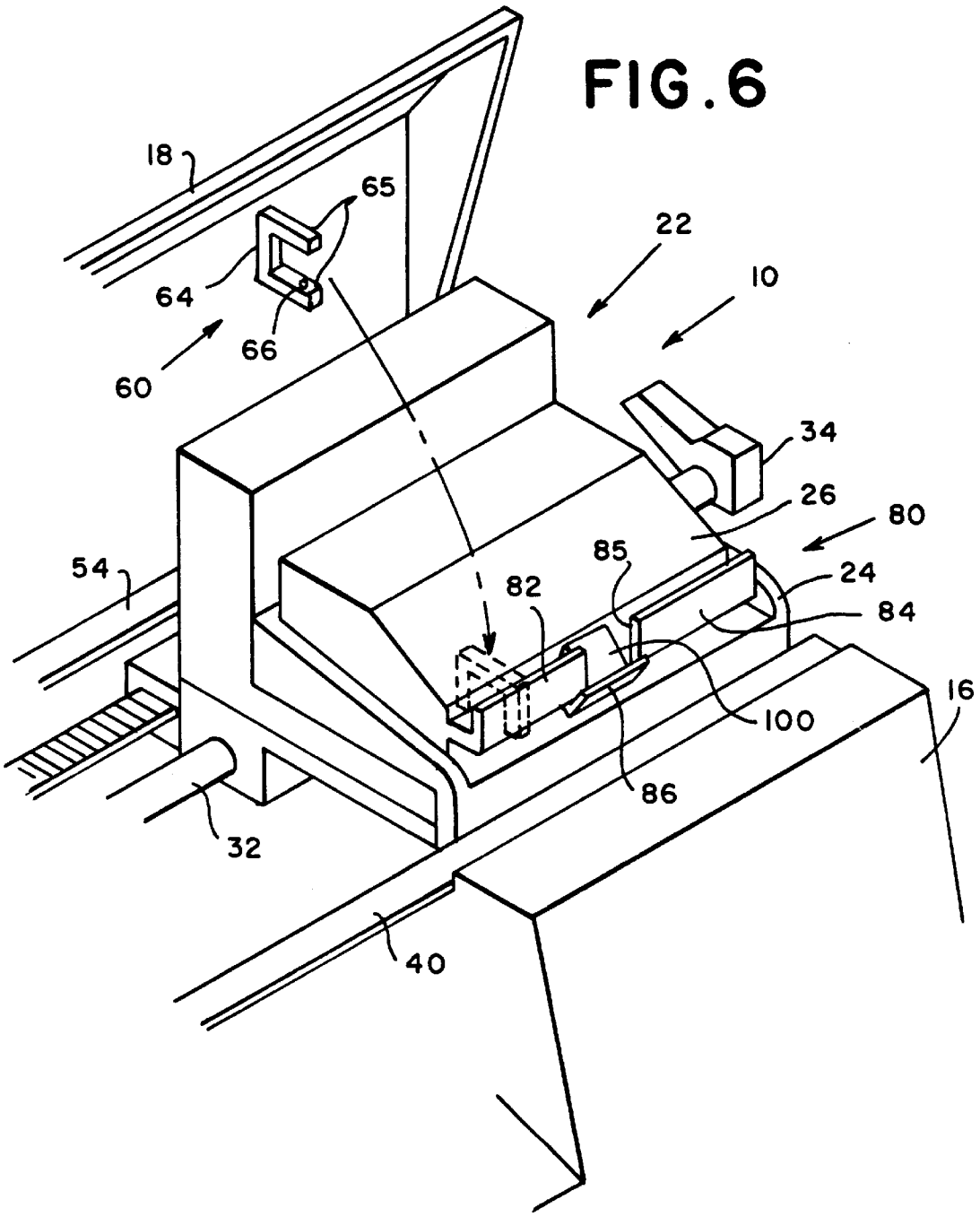
FIG. 6 is a fragmentary perspective view of the print head portion of the printing apparatus shown in FIG. 1, illustrating a modified form of ink cartridge flag which cooperates with the photo detector device to permit monitoring of the supply of ink in the cartridge to provide a signal when the level of ink drops below a level adequate for normal operation of the printing device.
Figure 7:
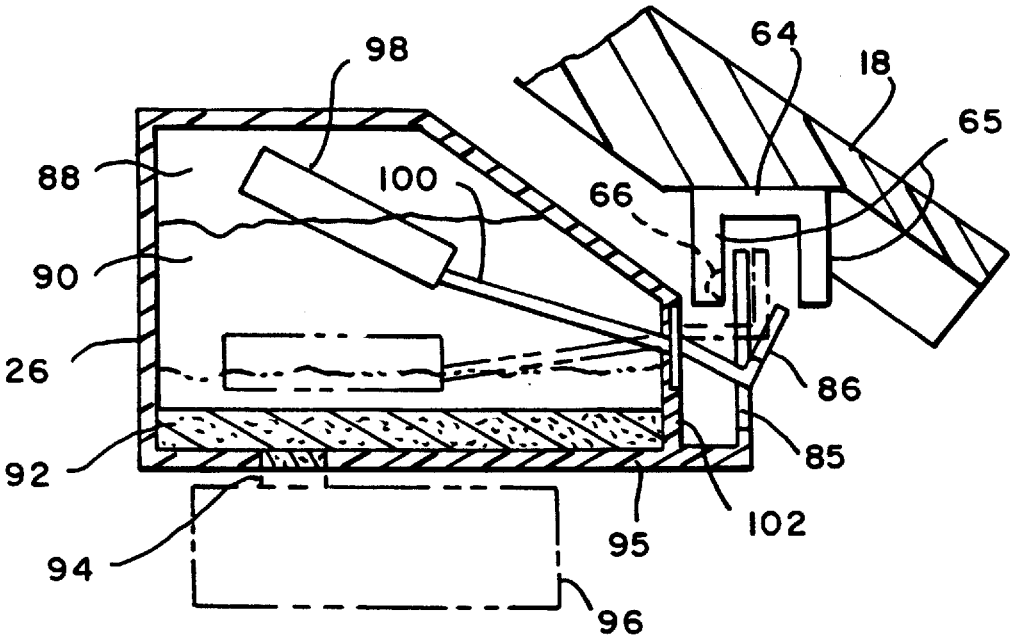
FIG. 7 is a fragmentary side sectional view of the ink cartridge utilized in one embodiment of the invention illustrated in FIG. 6.
Figure 8:
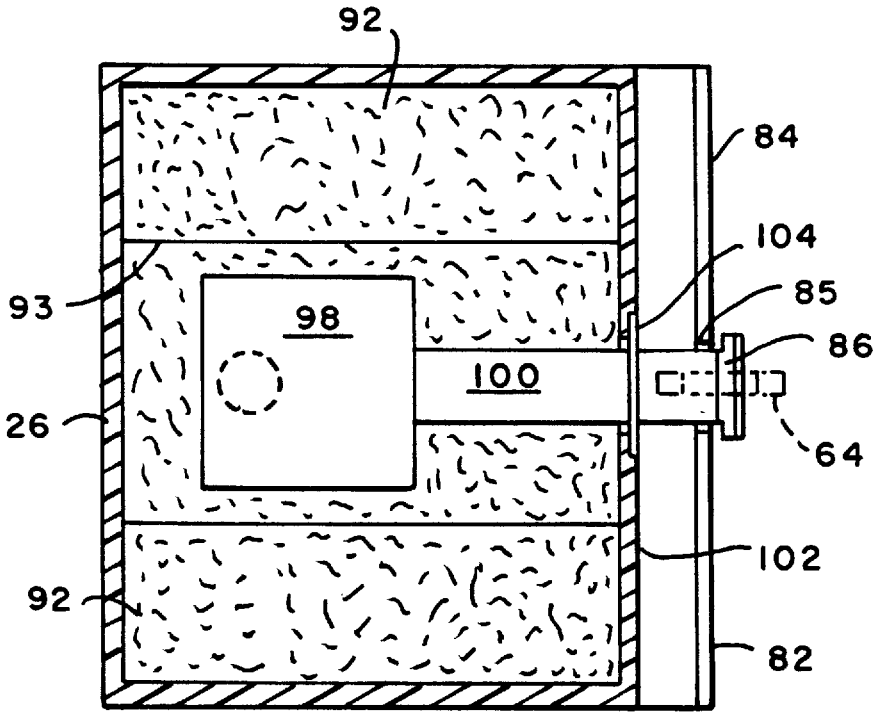
FIG. 8 is a fragmentary plan sectional view of the ink cartridge shown in FIG. 7.
Figure 9:
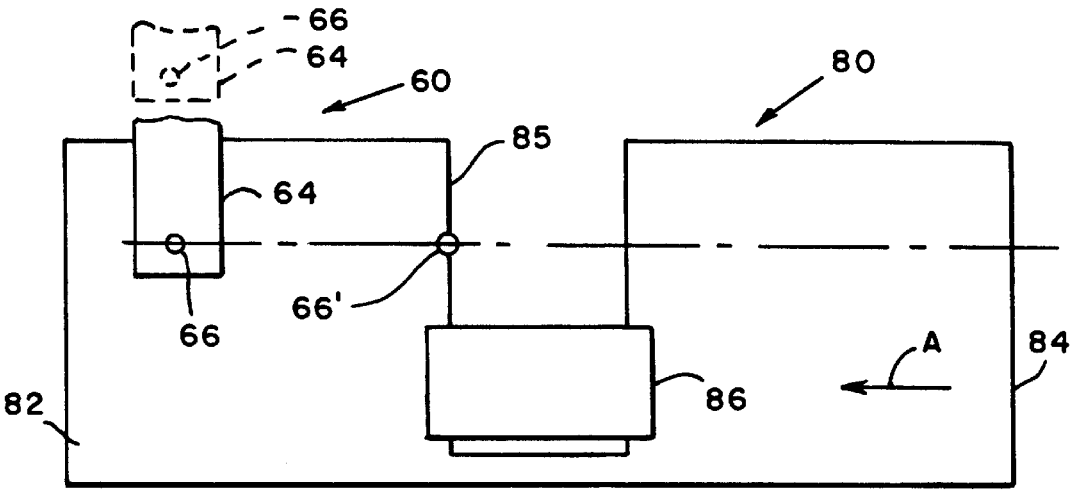
FIG. 9 is a fragmentary view of the photo detector device and the flag mounted on the ink cartridge shown in FIGS. 6 through 8, showing the operational characteristics of the photo detector device when ink cartridge is full.
Figure 10:
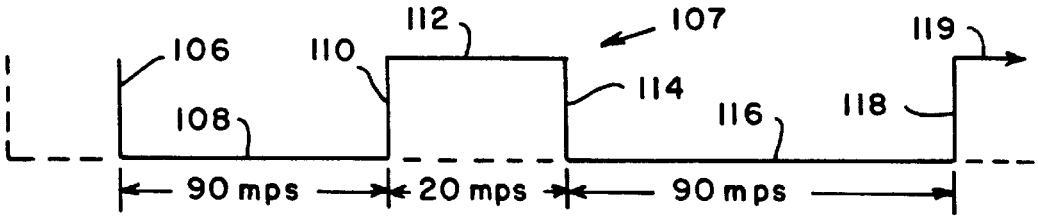
FIG. 10 is a line diagram illustrating the respective "on" and "off" operational characteristics of the photo detector device illustrated in FIG. 9.
Figure 11:
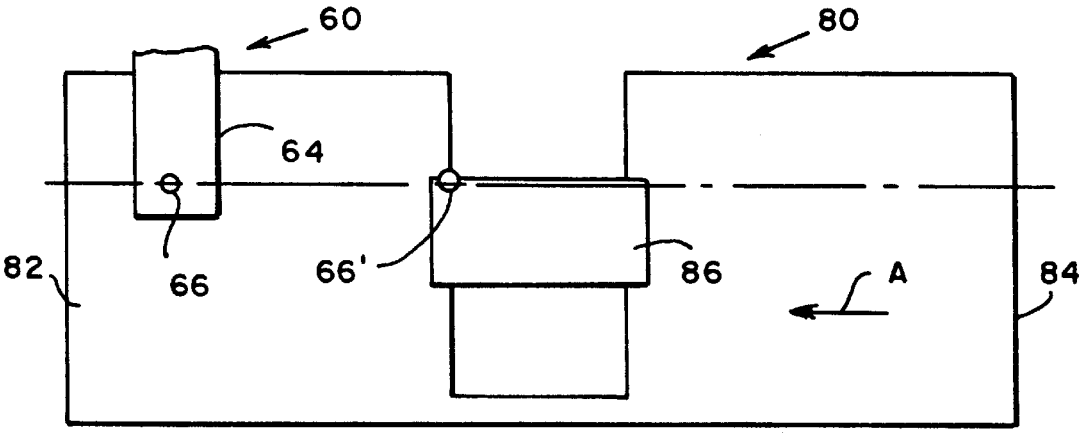
FIG. 11 is a view similar to FIG. 9 showing the operational characteristics of the photo detector device when the ink cartridge is empty.

FIGS. 6, 7 and 8 illustrate another embodiment of the invention in which the sensing means is utilized to provide an indication of when the ink in the ink cartridge is depleted to a level which is insufficient for normal operation of the printing apparatus 10 to continue printing indicia images. Thus, the fragmentary portion of the printing apparatus 10 shown in FIG. 6 is the same as that shown in FIG. 1, and corresponding reference numbers indicate like parts, including the housing 16, the cover 18, the print head 22, the ink cartridge housing 24, the ink cartridge 26, the guide rail 32, the support bracket 34, the forward guide bar 40, the drive belt 54, the photo detector 60, the housing 64 and the light emitter 66.

The ink cartridge 26 in this embodiment of the invention is provided with a different type of flag, indicated generally by the reference numeral 80, and is seen in FIG. 6 to comprise a pair of spaced apart, generally vertical left and right sections 82 and 84 respectively which are fixedly mounted on the ink cartridge 26 and which define a slot 85 therebetween. The flag 80 also includes a relatively short middle section 86 which is movably mounted on the ink cartridge 26 (in a manner described below) in the slot 85 between the fixed vertical sections 82 and 84. As best seen in FIGS. 7 and 8, the ink cartridge 26 is formed as an enclosed chamber 88 which contains a supply of ink 90. A suitable foam pad 92 having a central groove 93 is disposed in the -chamber to provide correct capillary flow of the ink 90 through an outlet 94 in a bottom wall 95 of the chamber 88 to the manifold portion 96 of the print head 22 which contains the nozzle plate 28 and the apertures 30.

A float 98 is mounted on an arm 100 which is suitably pivotally connected to a front wall 102 of the ink cartridge 26 and moves up and down within the groove 93 of the foam pad 92. The short flag section 86 is connected to the other end of the arm 100 on the other side of the wall 102 from the float 98. A suitable diaphragm or other flexible member 104 is placed over the connection of the arm 100 to the front wall 102 to prevent ink from leaking from the chamber 88. Alternatively, the ink may be contained in a collapsible bladder which is suitably connected to the outlet 94, and on which the float 98 rests as the bladder collapses from loss of ink during operation of the printing apparatus 10.

As best seen in FIG. 7, when the chamber 88 is filled with ink, the short flag section 86 is disposed beneath the level of the housing 64 of the photo detector 60, so that light from the light emitter 66 is received by the light receptor mounted in the opposite leg 65 of the housing 64, thereby resulting in the photo detector 60 being in an "on" condition. As the ink 90 is depleted, the float 98 follows the receding surface of the ink, or the collapsible bladder, as the case may be, until the short flag portion 86 rises sufficiently to obstruct light from the light emitter 66 reaching the light receptor, which thereby causes the photo detector 60 to change to an "off" condition, the effect of which is further explained below.

FIGS. 9 through 12 illustrate the changes in the operational condition of the photo detector 60 in this embodiment of the invention during operation of the printing apparatus 10, both while there is an ample supply of ink in the ink cartridge 26 and after the supply of ink becomes insufficient for printing operations to continue. Thus, with reference first to FIGS. 9 and 10, the left and right fixed vertical portions 82 and 84 of the flag 80 are each, for purposes of illustration, 90 motor pulses in length, and the short movable flag portion 86 is 20 motor pulses in length, thereby accounting for the 200 motor pulse length of the entire flag 80. When the cover 18 is closed, and assuming that an ink cartridge 26, with the flag 80 in place, is properly installed on the print head 22, light from the light emitter 66 is obstructed from reaching the light receptor by the left portion 82 of the flag 80, which causes the photo detector 60 to change from the "on" to the "off" condition in the same manner as that described above in connection with the previous embodiment of the invention. The microprocessor 31 recognizes this change in condition as indicating that the printing apparatus 10 is in condition for operation. This change is represented by the vertical segment 106 of the solid line generally indicated by the reference numeral 107 in FIG. 10.

As the print head 22 begins to move in the direction of the arrow A, the photo detector 60 remains in an "off" condition, as indicated by the horizontal segment 108 of the line 107, until the right edge of the left hand portion 82 reaches the photo detector 60, as indicated by the circle 66'. At this point the photo detector 60 reverts back to an "on" condition, as represented by the vertical segment 110 because the short flag section 86 is in its lower most position as represented by the solid line position in FIGS. 7 and 9, and in which position it does not obstruct light from the light emitter 66 from reaching the light receptor. However, the microprocessor 31 has been programmed to recognize the "on" condition of the photo detector 60, after having counted 90 motor pulses of movement of the print head 22, as indicating that there is sufficient ink in the chamber 88 to maintain normal printing operation of the print head 22. Therefore, at this point, the microprocessor 31 will not activate the indicating/disabling device 33. The microprocessor 31 has also been programmed to recognize that the "on" condition will remain for the next 20 motor pulses of movement of the print head 22, as indicated by the horizontal segment 112 of the solid line 107. After the additional 20 motor pulse count movement of the print head 22, the right hand portion 84 of the flag 80 will obstruct light from the light emitter 66 from reaching the light receptor, and this will cause the photo detector 60 to revert back to the "off" condition, as indicated by the vertical segment 114 of the line 107. The print head 22 then moves through the remaining 90 motor pulses of movement, as indicated by the horizontal segment 116 of the line 107, until the right edge of the right hand portion 84 of the flag 80 passes the photo detector 60, at which point it again reverts to an "on" condition, as indicated by the vertical segment 118 of the line 107, and as with the previous embodiment, it will remain in this condition, as indicated by the horizontal segment 119 until the print head 22 completes the printing operation and returns to the standby position. However, in the same manner as set forth in connection with the previous embodiment, the microprocessor 31 has now received the 200 motor pulse count from the pulse counter 35, indicating that the print head 22 has reached the standby position and is ready to print, with the result that the microprocessor 31 does not activate the indicating/disabling device 33 so that the printing operation can continue.

Figure 12:
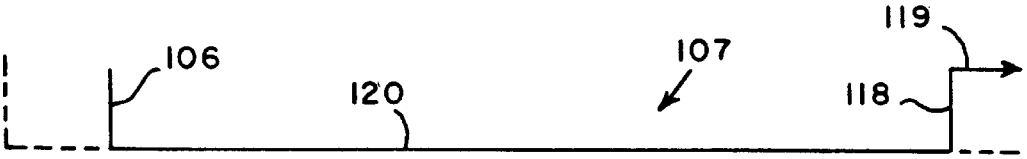
FIG. 12 is a view similar to FIG. 10 for the operational characteristic of the photo detector device shown in FIG. 10.

With reference now to FIGS. 11 and 12, when the supply of ink 90 has been depleted to a level where the supply is inadequate for further operation of the printing apparatus 10, as indicated by the dotted line position of the float 98 and the short flag section 86 in FIG. 7, the initial stage operation of the print head 22 is the same as that described above in connection with FIGS. 10 and 11, with the exception that when the right edge of the left hand portion 82 of the flag 80 reaches the photo detector 60, the short flag portion 86 will now obstruct light from the light emitter 66 from reaching the light receptor. This will cause the photo detector 60 to remain in the "off" condition that has prevailed during the first 90 motor pulse movement of the print head 22, as indicated by the continuous horizontal segment 120 of the line 107 in FIG. 12. However, as previously mentioned, the microprocessor 31 has been programmed to recognize an "off" to "on" change in the operational condition of the photo detector 60, after the first 90 motor pulse movement of the print head 22 as indicating that there is an ample supply of ink in the ink cartridge 26. Therefore, the absence of this operational change in condition of the photo detector 60, after the first 90 motor pulse count, indicates that there is only sufficient ink remaining in the ink cartridge 26 for one, or any minimum number of printing cycles that may be desired. This triggers the microprocessor 31 to actuate the indicating/disabling device 33 to provide the appropriate indication that this problem exists, and/or to disable further operation of the printing apparatus 10 after completion of the one or the predetermined number of additional printing cycles. In either event, further movement of the print head 22, as indicated by the lines 118 and 119 in FIG. 12, will continue in the same manner as described above in connection with FIGS. 9 and 10.

FIGS. 13 through 19 illustrate a variation of the embodiment of the invention shown in FIGS. 6 through 12. In variation, the central short flag portion of the total flag provided on the ink cartridge has a sloping upper surface rather than a flat surface. As further described below, the advantage of this feature is that the sensing means, of which the flat is a part, can provide an ongoing analog status of the supply of ink in the ink cartridge, similar to the gas gauge of an automobile, rather than merely the digital status as in the previous embodiment in which the quantity of ink in the ink cartridge is unknown until it drops below the level sufficient for further operation of the printing apparatus 10.

Figure 13:
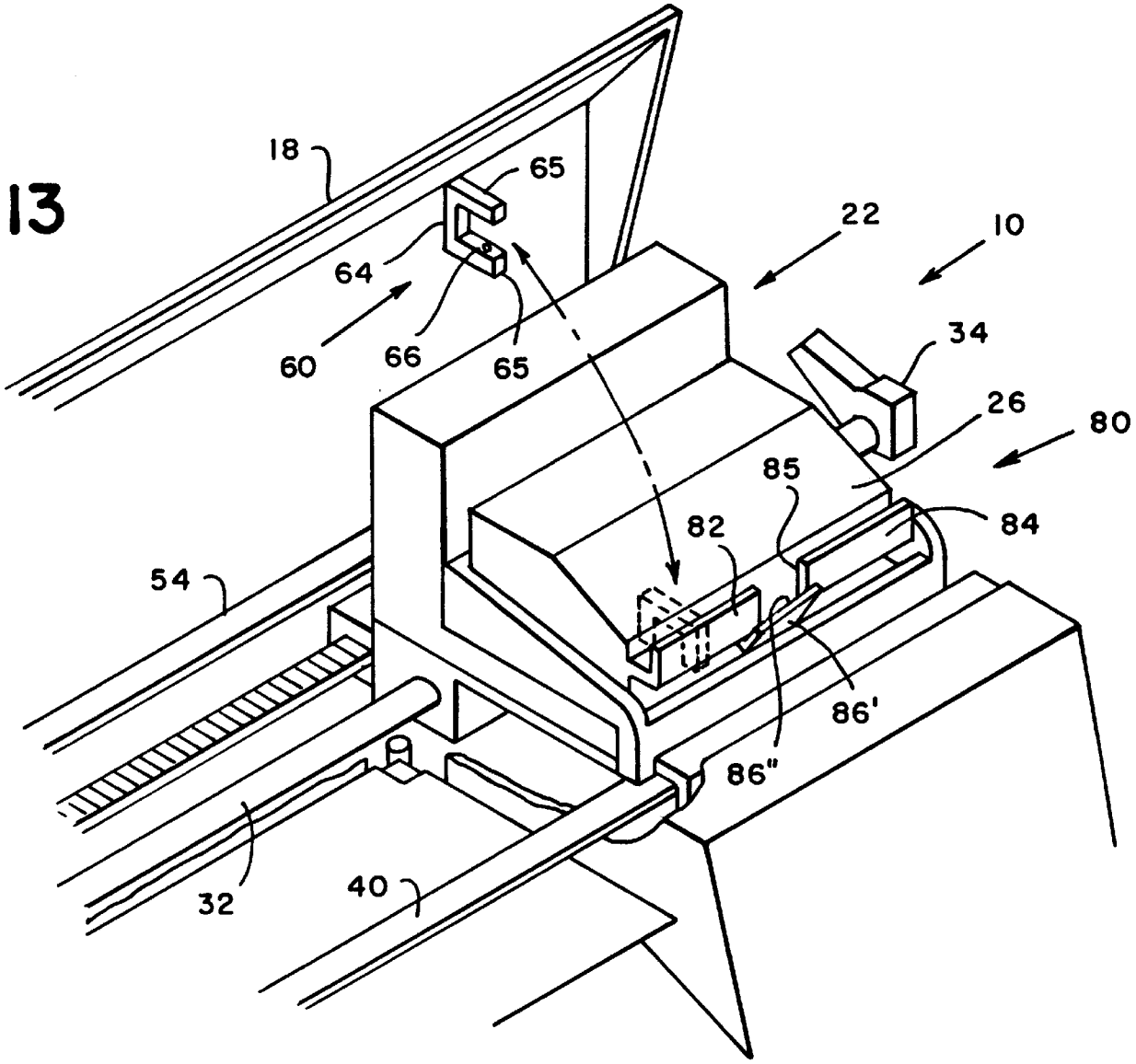
FIG. 13 is a view similar to FIG. 6 but showing a variation of the ink cartridge flag shown in FIG. 6 in which the supply of ink is monitored in such a way that the amount of ink in the ink cartridge can be ascertained at any level between full and empty.

Thus, with reference to FIG. 13, the fragmentary portion of the printing apparatus 10 shown therein is identical to that shown in FIGS. 1 and 6, again with like reference numbers indicating identical parts, with the exception of the movable short portion 86' of the flag 80', which has an upper edge 86" that is slanted upwardly in a left to right direction as viewed in FIG. 13 and the subsequent figures, rather than being horizontal as in the configuration shown in FIG. 6.

The operational effect of this configuration on the photo detector 60 is shown in FIGS. 14 through 19, which illustrate a progression of the positions of the short flag section 86' as the ink in the ink chamber 88 is gradually depleted during use of the printing apparatus 10 from full to insufficient for further operation. Considering firstly FIGS. 14 and 15, they show the changes in the operational condition of the photo detector 60 when the ink cartridge is full. Thus, the initial conditions with respect to the cover 18 being closed, the ink cartridge 26 being present and the print head 22 being in the storage or standby positions are the same as in the previous variation shown in FIG. 6, and are indicated by the vertical segment 122 of the solid line indicated generally by the reference numeral 123 in FIG. 15. Further, the initial displacement of the print head 22 through the first 90 motor pulse count distance, as indicated by the horizontal segment 124, is the same as in the previous variation.

Figure 14:
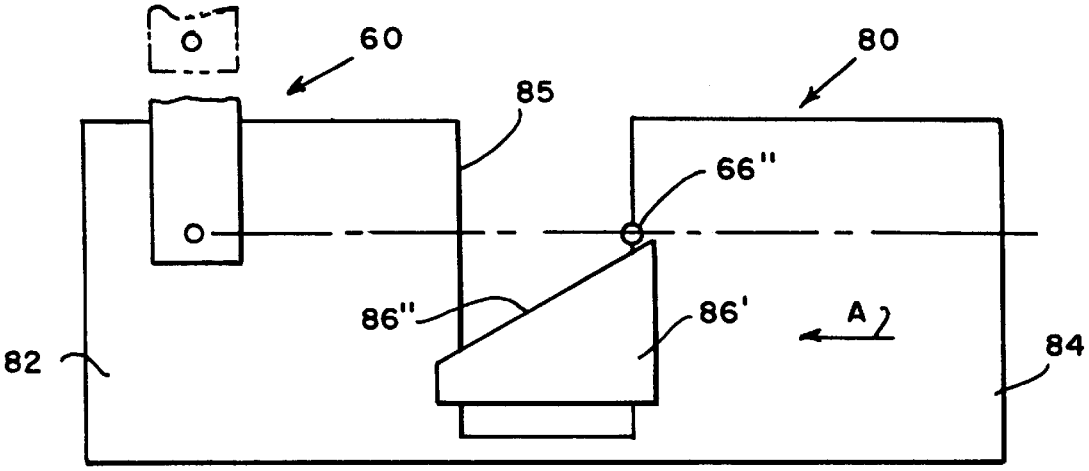
FIG. 14 is a view similar to FIG. 2 showing the operational characteristics of the photo detector device when the ink cartridge is substantially full of ink.
Figure 15:
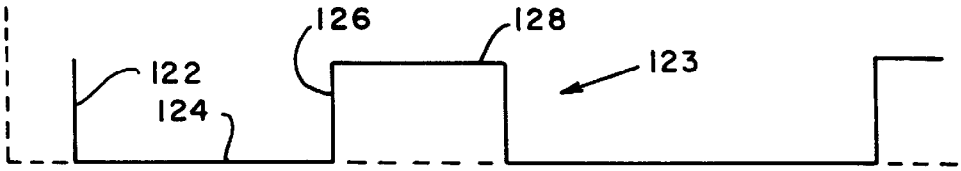
FIG. 15 is a view similar to FIG. 3 illustrating the respective "on" and "off" operational characteristics of the photo detector device illustrated in FIG. 14.

At the end of this movement, the right side of the left hand flag portion 82 no longer obstructs light from the light emitter 66" from reaching the light receptor, which thereby changes the condition of the photo detector 60 from "off" to "on", as indicated by the vertical segment 126 of the solid line 123. As seen in FIG. 14, when the ink chamber 88 is full, the short flag portion 86' is in its lower most position, with the result that the entire slanted upper edge 86" is below the level of the light emitter 66", with the result that the photo detector 60 remains in the "on" condition during the 20 motor pulse count distance represented by the horizontal segment 128 of the line 123. Again, as with the previous embodiment, the microprocessor 31 has been programmed to recognize the "on" condition of the photo detector 60, after the initial 90 motor pulse count movement of the print head 22, as indicating a full supply of ink, with the result that the microprocessor 31 does not activate the indicating/disabling device 33 to either provide the operator warning indication or disable further operation of the printing apparatus 10. The operational effect of the remaining 110 motor pulses of the 200 motor pulse count movement of the print head 22 in this variation is the same as that of the previous variation shown in FIGS. 9 and 10, so that further description thereof is not deemed necessary.

Figure 16:
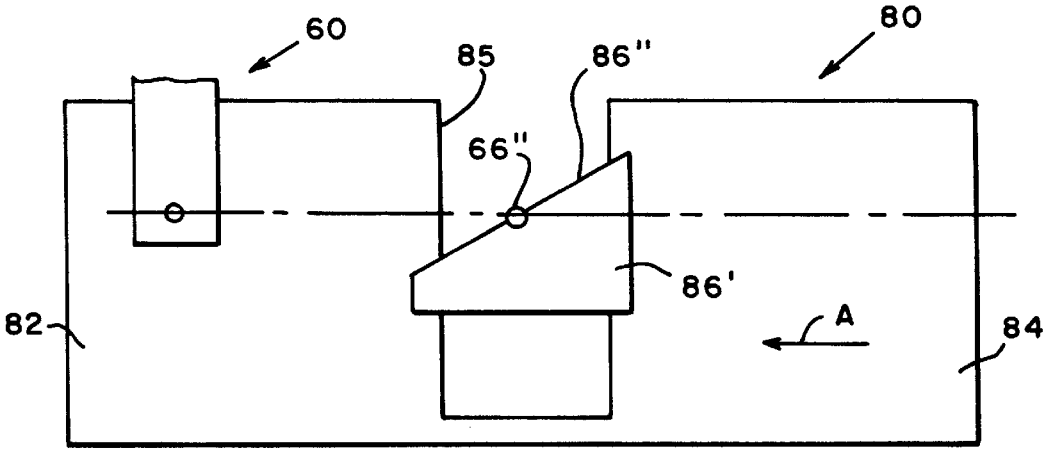
FIG. 16 is a view similar to FIG. 14 showing the operational characteristics of the photo detector device when the ink in the cartridge is approximately one half depleted.
Figure 17:
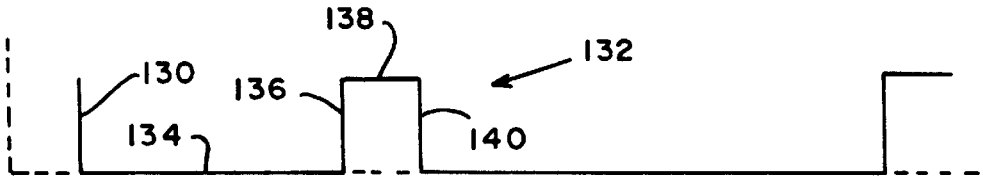
FIG. 17 is a view similar to FIG. 15 illustrating the "on" and "off" operational characteristics of the photo detector device illustrated in FIG. 16.

FIGS. 16 and 17 show the operational effect of the changes in condition of the photo detector 60 when the ink 90 in the chamber 88 has been depleted to approximately one half of the normal full supply. In this situation, the short flag section 86' has moved upwardly in the slot 85 through approximately one half of the full extent of its vertical movement, with the result that the upper slanted edge 86" will obstruct the light from the light emitter 66" from reaching the light receptor at about the mid point of the slanted edge 86", as shown in FIG. 16. The operational effect of this on the photo detector 60 is illustrated in FIG. 17, in which the vertical segment 130 of the solid line, indicated generally by the reference numeral 132, represents the change in condition from "on" to "off" when the cover 18 is closed, the horizontal segment 134 represents the first 90 motor pulse count movement of the flag 80 in the direction of the arrow A, and the vertical segment 136 represents the change in condition from "off" back to "on" when the right edge of the left flag portion 82 reaches the light emitter 66" of the photo detector 60. As the flag 80 continues to move in this direction, the upper edge 86" of the short flag portion 86' will reach the photo detector 66" after only a further 10 motor pulse count, i.e., one half of the original 20 motor pulse count movement of the previous variation of this embodiment, this movement being represented by the horizontal segment 138 of the line 132, which is only one half the length of the horizontal segment 128 shown in FIG. 15. Again, since the microprocessor 31 has been programmed to recognize the change in status of the photo detector 60, after the first 90 motor pulse count movement of the print head 22, as indicating that there is an ample supply of ink in the ink cartridge 26, the micrproprocessor 31 does not activate the indicating/disabling device 33. When the upper edge 86" of the short flag portion 86' does obstruct light from the emitter 66 from reaching the light receptor, the photo detector 60 reverts back to an "off" condition, as indicated by the vertical segment 140 of the line 132, after which normal operation of the print head 22 continues in the same manner as described above in connection with FIG. 10.

Figure 18:
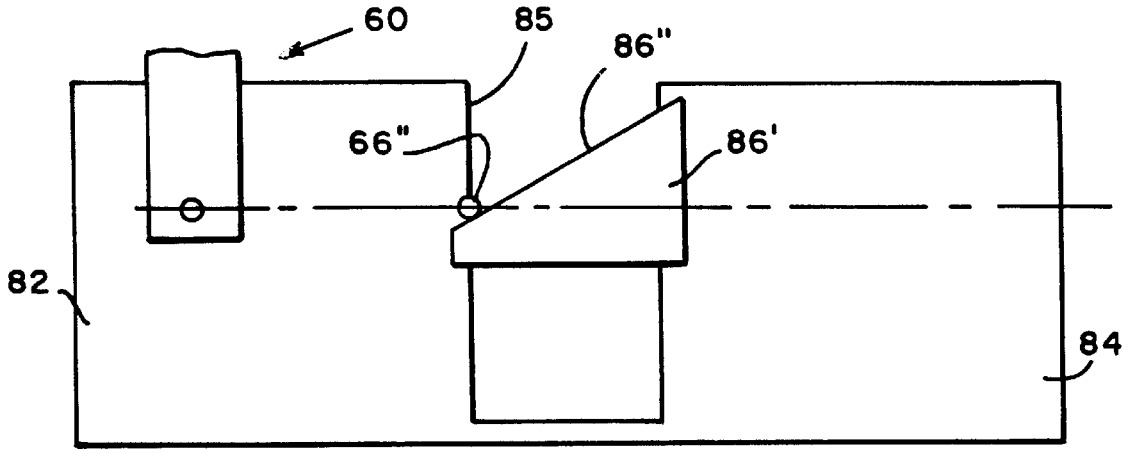
FIG. 18 is a view similar to FIG. 16 showing the operational characteristic of the photo detector device when the ink in the cartridge has been depleted to a level inadequate for normal operation of the printing device.
Figure 19:
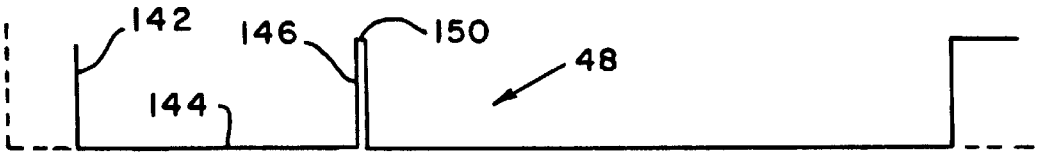
FIG. 19 is a view similar to FIG. 17 illustrating the "on" and "off" operational characteristics of the photo detector device illustrated in FIG. 18.

FIGS. 18 and 19 show the operational effect of the changes in condition of the photo detector 60 when the ink 90 in the chamber 88 has been depleted to a level which is no longer sufficient for continued normal operation of the printing apparatus 10. This level can vary from virtually no ink at all, in which case perhaps only one or a few printing operations may still be carried out, to some minimal level which will allow perhaps approximately 10 or 25 or some other relatively small number, so that the printing apparatus 10 can continue to operate normally even after a determination has been made that it is time to replace the ink cartridge 26.

In this situation, the short flag section 86' has moved upwardly in the slot 85 through substantially the full extent of its vertical movement, with the result that the upper slanted edge 86" will obstruct the light from the light emitter 66" from reaching the light receptor almost immediately after the right edge of the left portion 82 of the flag 80 has pass the photo detector 60, as shown in FIG. 18. The operational effect of this on the photo detector 60 is illustrated in FIG. 19, in which the vertical segment 142, the horizontal segment 144 and the vertical segment 146 of the solid line, indicated generally by the reference numeral 148, indicate the same changes in the condition of the photo detector 60 as are represented by the corresponding lines in FIG. 17. As the flag 80 continues to move in the direction of the arrow A, the upper edge 86" of the short flag portion 86' will reach the photo detector 66" after only a further 1 or 2 motor pulse counts, since the short flag portion 86' is at or nearly at the top of the extent of vertical movement permitted by the float 98, this movement being represented by the very short horizontal segment 150 of the line 148, during which the photo detector 60 is in an "on" condition.

Unlike the previous situations of this variation of the invention, where the change in condition of the photo detector 60 from "off" to "on", after the first 90 motor pulse count movement of the print head 22, indicated an ample supply of ink for continued operation, in this situation the microprocessor 31 has been further programmed to recognize an "on" pulse of the photo detector 60 as short as 1 or 2 motor pulse counts as indicating that there is no longer an adequate supply of ink in the ink cartridge 26 for normal operation of the printing apparatus 10 beyond whatever limited number of printing cycles the ink cartridge 26 has been designed to deliver. Therefore, in response to the short "on" pulse of the photo detector 60, the microprocessor 31 now activates the indication/disabling device 33 either to generate an appropriate operator perceivable signal that the ink cartridge must be replaced, or to disable further operation of the printing apparatus 10 immediately or after a further predetermined number of printing cycles, or both, as previously explained.

From the foregoing description of the variation of the invention as shown in FIGS. 13 through 19, it should be apparent that, as the printing apparatus 10 continues to operate, the level of ink in the chamber 88 continuously drops, thereby causing the short flag portion 86' to continuously rise in the slot 85, thereby gradually obstructing light from the light emitter 66" from reaching the light receptor at progressively shorter intervals of motor pulse count movements after the right edge of the left hand portion 82 of the flag 80 moves beyond the photo detector 60. Thus, by merely programming the microprocessor 31 to recognize progressively shorter pulse counts as indicating progressively less ink in the chamber, e.g., 20 counts is full, 15 counts is three quarters full, 10 counts is half full, 5 counts is one quarter full, and 1 or 2 counts represents the desired minimum supply of ink on which the printing apparatus is to operate, it becomes possible for the microprocessor 31 to control the operation of any suitable form of analog gage or digital display, as indicated by the box labeled 41 in FIG. 20.

It is to be understood that the present invention is not to be considered as limited to the specific embodiments described above and shown in the accompanying drawings, which are merely illustrative of the best modes presently contemplated for carrying out the invention and which are susceptible to such changes as may be obvious to one skilled in the art, but rather that the invention is intended to cover all such variations, modifications and equivalents thereof as may be deemed to be within the scope of the claims appended hereto.

We claim:

1. A printing apparatus having various operating components, and means for sensing certain operational characteristics of the operating components to monitor the operational status thereof, said printing apparatus comprising:

A. a housing for containing various operating components of said printing apparatus, said housing including a cover and means mounting said cover for movement between a closed position and an open position in which said operating components are accessible, B. a print head disposed within said housing, C. means in said housing mounting said print head for reciprocating movement from a storage position to a standby position, from said standby position across a printing path, back across said printing path to said standby position, and back to said storage position, D. an ink cartridge mounted on said print head for movement therewith, E. a single sensing means operatively associated with said cover and said ink cartridge for monitoring changes in the status of certain operational characteristics of said cover, said print head and said ink cartridge, and F. means responsive to operation of said sensing means for generating an operator perceptible indication of a change in said status of said operational characteristics of said cover, said print head, and said ink cartridge, for altering the operation of said printing apparatus, in accordance with changes in the status of said operational characteristics of said cover, said print head and said ink cartridge, whereby an operator of said printing apparatus can be apprised of, and the operation of said printing apparatus can be controlled in response to, changes in said operational characteristics of said cover, said print head and said ink cartridge of said printing apparatus during operation thereof.

2. A printing apparatus as set forth in claim 1 wherein said single sensing means comprises A. a condition detecting means mounted on said cover, and B. actuating means mounted on said ink cartridge for actuating said condition detecting means in accordance with said changes in the status of said operational characteristics.

3. A printing apparatus as set forth in claim 2 wherein

A. said condition detecting means comprises a photo detector device, and

B. said actuating means comprises means for altering the condition of light within said photo detector in response to change in the status of said operational characteristics.

4. A printing apparatus as set forth in claim 3 wherein

A. said photo detector comprises a substantially U-shaped housing secured to the inside surface of said cover, said U-shaped housing having a pair of spaced apart legs depending from said inside surface of said cover, a light emitter disposed in one of said legs and a light receptor disposed in the other of said legs, and B. said actuating means comprises an elongate element mounted on said ink cartridge in a position such that said elongate element is disposed between said depending legs of said U-shaped housing when said cover is in said closed position, whereby said elongate element obstructs the passage of light from said light emitter from reaching said light receptor when said cover is in said closed position, said ink cartridge is mounted on said print head, and said print head is disposed at said storage position or said standby position.

5. A printing apparatus as set forth in claim 4 wherein said elongate element extends substantially the distance of movement of said print head between said storage position and said standby position, whereby said print head with said in cartridge mounted thereon can move laterally from said storage position to said standby position while said elongate element remains within said depending legs of said U-shaped body.

6. A printing apparatus as set forth in claim 5 wherein said means for providing said operator perceptible indication for altering the operation of said printing apparatus comprises A. counter means responsive to movement of said print head from said storage position toward said standby position for generating successive signals each representative of a discrete increment of movement of said print head, B. a microprocessor for controlling various operations of said printing apparatus, said microprocessor being connected to said counter means and being responsive to a predetermined number of said signals, which number represents a predetermined movement of said print head, for ascertaining whether any of said operational characteristics of said cover, said print head and said ink cartridge are inappropriate for continued operation of said printing apparatus, and C. indicating/disabling means responsive to operation of said microprocessor in determining that any of said operational characteristics are inappropriate for continued operation of said printing apparatus for generating said operator perceptible indication and altering the operation of said printing apparatus.

7. A printing apparatus as set forth in claim 6 wherein

A. said elongate element is continuous from one end thereof to the other, and

B. said microprocessor includes software which programs said microprocessor to normally activate said indicating/disabling means when said elongate element is not positioned between said legs of said U-shaped housing, and also to recognize a signal count from said counter means that is representative of the extent of movement of said print head from said storage position to said standby position for preventing said microprocessor from activating said indicating/disabling means even after said print head passes said standby position and enters said printing path.

8. A printing apparatus as set forth in claim 6 wherein

A. said elongate member includes a slot formed therein which is positioned within the range of said condition detecting means, and B. said ink cartridge includes a chamber for storing a quantity of ink, means disposed in said chamber for monitoring the supply of ink therein, and means disposed outside of said chamber and within said slot and operatively connected to said monitoring means for actuating said condition detecting means to detect whether there is sufficient ink in said chamber for normal operation of said printing apparatus.

9. A printing apparatus as set forth in claim 8 wherein said means disposed outside of said chamber for actuating said condition detecting means comprises a relatively short segment of said elongate member that is vertically movable in said slot in response to the level of ink in said chamber so as to cause said short segment of said elongate member to be disposed between said legs of said housing when the quantity of ink in said chamber is depleted to a level that is no longer adequate for normal operation of said printing apparatus.

10. A printing apparatus as set forth in claim 9 wherein said microprocessor includes software which programs said microprocessor A. to normally activate said indicating/disabling means when no portion of said elongate element is positioned between said legs of said U-shaped housing, B. to recognize a signal count from said counter means that is representative of the extent of movement of said print head from said storage position to a location where said short segment of said elongate member will be disposed between said legs of said detector housing if the supply of ink in said chamber is depleted to said sufficiently low level, and C. to be responsive to said signal count for preventing said microprocessor from activating said indicating/disabling device if the supply of ink in said chamber is not sufficiently low to cause said short segment of said elongate member to be disposed between said legs of said housing.

11. A printing apparatus as set forth in claim 10 wherein said short segment of said elongate member is generally rectangular with a flat upper edge that extends parallel to the direction of movement of said print head, whereby said short segment provides a digital indication of whether the level of ink in said chamber is above or at the level at which the supply of ink is insufficient for continued normal operation of said printing apparatus.

12. A printing apparatus as set forth in claim 9 wherein said short segment of said elongate member includes an upper edge that is slanted downwardly in the direction of movement of said print head from said storage position toward said standby position, whereby said short segment activates said condition detecting means after varying degrees of movement of said print head from said storage position toward said standby position so as to provide an ongoing indication of the amount of ink in said chamber as the supply of ink therein is depleted during operation of said printing apparatus.

13. A printing apparatus as set forth in claim 12 wherein said microprocessor includes software which programs said microprocessor A. to normally activate said indicating/disabling means when no portion of said elongate element is positioned between said legs of said U-shaped housing, B. to recognize a signal count from said counter means that is representative of the extent of movement of said print head from said storage position to a location where said short segment of said elongate member will be disposed between said legs of said detector housing if the supply of ink in said chamber is depleted to said sufficiently low level, and C. to be responsive to said signal count for preventing said microprocessor from activating said indicating/disabling device if the supply of ink in said chamber is not sufficiently low to cause said short segment of said elongate member to be disposed between said legs of said housing.

* * * * *